United States Patent [19]

Murphy

[11] 4,249,664

[45] Feb. 10, 1981

[54] RIGIDIFYING ARRANGEMENT FOR SELF LUBRICATING YOKE WEAR PLATE ASSEMBLIES

[75] Inventor: Richard F. Murphy, Batavia, Ill.

[73] Assignee: Holland Company

[21] Appl. No.: 61,933

[22] Filed: Jul. 30, 1979

[51] Int. Cl.[3] ..... B61G 7/10

[52] U.S. Cl. ..... 213/61; 213/21; 213/51

[58] Field of Search ..... 213/61, 21, 51, 63, 213/62 R, 62 A, 67 R, 67 A, 69

[56] References Cited

U.S. PATENT DOCUMENTS

| | | | |
|---|---|---|---|
| 3,610,436 | 10/1971 | Wisler | 213/62 A |
| 4,055,254 | 10/1977 | Chierici et al. | 213/61 |

*Primary Examiner*—Richard A. Bertsch

*Attorney, Agent, or Firm*—McWilliams, Mann & Zummer

[57] ABSTRACT

A rigidifying arrangement for self lubricating wear plate assemblies employed for supporting the inner end of the vertical yoke used in railroad car coupler draft gear rigging, in which the wear plate is in the form of a planar support plate equipped with the special liner of Chierici and Murphy U.S. Pat. No. 4,055,254 for supporting the yoke inner end at its operative level within the car center sill. The support plate is rigidified to maintain its planar configuration under the weight of the draft gear and yoke acting on it, by affixing to same along its longitudinal center line a depending flange structure defining a vertical flange of rectilinear configuration and a horizontal flange integral with the vertical flange along the lower edge of the latter and spaced from the support plate. The rigidifying flange structure not only maintains the support plate, and thus the liner surfacing on which the yoke rides in planar relation for achieving maximum benefits of the invention of said patent, but also the support plate itself may be of much thinner gauge than conventionally employed for yoke wear plates.

6 Claims, 5 Drawing Figures

RIGIDIFYING ARRANGEMENT FOR SELF LUBRICATING YOKE WEAR PLATE ASSEMBLIES

This invention relates to a self lubricating wear plate arrangement for railroad car draft gear rigging yokes, and more particularly, to a rigidifying arrangement for self lubricating wear plate arrangement for supporting the inner end of the yoke of coupler draft gear rigging of the special type disclosed in Chierici and Murphy U.S. Pat. No. 4,055,254, the entire disclosure of which is incorporated herein by this reference.

Draft gear rigging for, for instance, AAR type F interlocking couplers conventionally comprises a draft gear applied within the center sill draft gear pocket, between pairs of stop lugs fixed to the center sill on either side of same, which pairs of stop lugs are spaced apart longitudinally of the center sill. The draft gear is embraced by a vertical yoke extending longitudinally of the car and operably connected to the coupler by a vertical connector pin that is supported by and rides on a support plate secured across the underside of the center sill and also supporting the outer end of the yoke. The inner end of the yoke is supported by and rides on a wear plate that is secured across the underside of the center sill, and it is upwardly indented to dispose the yoke inner end in proper working alignment level with the coupler longitudinally of the center sill. Additionally and conventionally, a flat safety plate is secured across the underside of the center sill between the connector pin support plate and the yoke wear plate, this safety plate normally being disposed below and spaced from the underside of the yoke.

As the draft gear operates to accommodate buff and draft impacts acting on the coupler, the yoke slides back and forth on its wear plate, which results in wear on both the wear plate and yoke that is accentuated by a downward acting vector in the forces acting on the wear plate, due to the location of the yoke wear plate at the inner end of the yoke. While the yoke wear plates are relatively easy to replace, the yokes themselves are not because of their embracing relation with the draft gear. AAR regulations require that when the yoke at its inner end has worn away about ⅜ths of an inch, the yoke must be repaired or replaced.

This required repair or replacement of the yoke necessarily involves shopping of the car for removal of the draft gear rigging and separation of the yoke from the draft gear, so that the yoke can be replaced or serviced. The worn yoke is conventionally restored to working condition by filling in its worn area with weld material, grinding down the surface involved to the needed level, and then suitably heat treating the yoke to get the repaired area of same to the required hardness. After these time consuming procedures, the yoke is then available for re-use.

The familiar AAR type E coupler draft rigging arrangement involves the familiar horizontal key connecting the yoke to the coupler, with the yoke resting on one or more wear plates secured across the underside of the center sill and either upwardly indented or built up within the center sill, to dispose the yoke in proper working alignment level with the coupler, longitudinally of the center sill. The wearing action on the yoke in these arrangements presents the same problems referred to above with regard to yoke and wear plate replacement.

In accordance with the invention of said Chierici and Murphy patent, the conventional yoke wear plate of draft rigging for AAR type interlocking couplers is replaced by a wear plate assembly comprising a planar support plate that is secured at the same position as a conventional yoke wear plate, and that is equipped with a special liner for supporting the yoke inner end at its operative level within the car center sill. The liner is formed from an ultra high molecular weight polymer material that is of dry self lubricating nature, and resists adherence thereto of foreign material. The material from which the liner is formed is also characterized by its tendency to reform the yoke underside surface portion riding on same whereby such yoke underside surface portion defines a mirror finish that acts to inhibit further wear of the yoke during use.

The liner, which may be of either plate or tubular form, is applied to the planar support plate so that the liner material is interposed between the yoke and the new support plate in question. The new wear plate assembly is equipped to have the liner centered with respect to the yoke and center sill.

Experience in service with the arrangement of said Chierici and Murphy patent has revealed that the support plate on which the special liner is mounted tends to deflect out of its initial planar relation, due to the static and dynamic loads that act on it, so that the portion of the support plate between its connection to the center-sill becomes arced downwardly somewhat, so that the underside of the yoke lower strap is not in full engagement with the liner; the result is the yoke lower strap will tend to ride on the liner along the side edges of the yoke lower strap, and be spaced from the liner along the center of the yoke lower strap, thereby reducing the effectiveness of the liner both from the standpoint of the resurfacing of the lower yoke strap undersurfacing and the support of the draft gear at the desired working level alignment with the coupler.

The principal object of this invention is to provide a rigidifying arrangement for the self-lubricating yoke wear plate assembly of said Chierici and Murphy patent that effectively hold the liner support plate in its desired planar relation.

Another principal object of the invention is to effect the needed rigidifying of the self lubricating yoke wear plate assembly involved by applying to the underside of the liner support plate a single rigidifying flange structure that may be of one piece construction and that may be preassembled with the support plate for convenience of mounting the assembly in operative relation.

Yet another important object of the invention is to provide a yoke wear plate arrangement of the type indicated that is economical of manufacture, easy to install in both new and used equipment, and that is long lived in operation.

In accordance with the present invention, the liner support plate has affixed to the underside of same along the longitudinal midportion of same a depending flange structure that includes a vertically disposed flange fixed, as by employing weld, along the upper edge of same to the support plate, and a horizontal flange along its lower edge that projects normally of the vertical flange. The depending flange structure, which may be of one piece construction, is coextensive with the liner and parallels same. The results provided not only include the firm holding of the liner support plate in its desired planar relation, thereby insuring that the liner will likewise remain in its desired planar relation for effective load supporting and resurfacing action on the yoke, but also the liner support plate may be of substantially reduced gauge to perform its desired function. For instance, the support plate may be formed from bar stock having a gauge or thickness of one-quarter inch instead of a gauge or thickness of five eighths inch that is normally employed for conventional yoke wear plates.

Other objects, uses, and advantages will be obvious or become apparent from a consideration of the following detailed description and the application drawings in which like reference numerals are employed to indicate like parts throughout the several views.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

Figure 1:
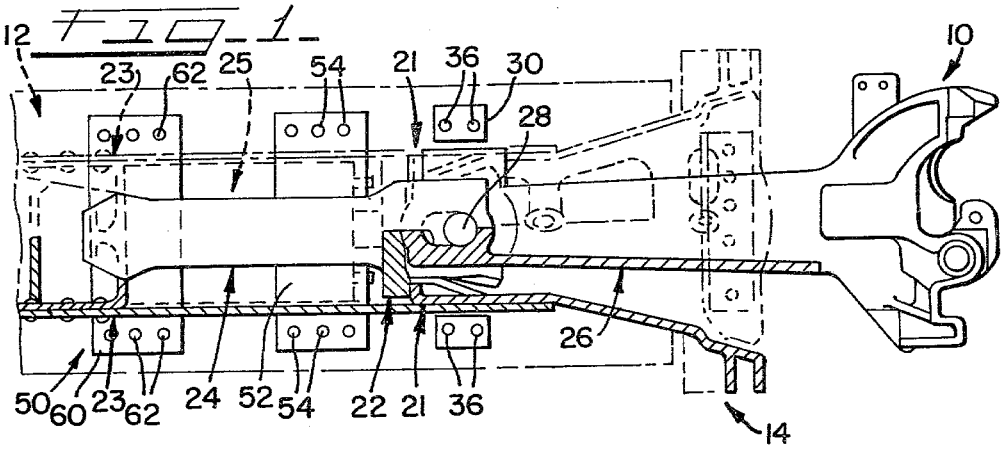
FIG. 1 is a diagrammatic plan view, partially in section, illustrating a typical mounting arrangement of an AAR type F interlocking coupler and draft rigging therefor, with parts being shown in phantom.

Reference numeral 10 of FIG. 1 generally indicates an AAR type F interlocking coupler applied to conventional center sill 12 that is an integral part of railroad car body 14 (the latter being largely omitted except for the relevant parts in the area of the operating location of the coupler 10).

The center sill 12 is of the usual inverted channel shape type, defining spaced side walls 16 and 16A each having laterally directed end flanges 18 and 18A, respectively.

The respective center sill side walls 16 and 16A each have applied to same, spaced apart, forward stop lugs 21 and rearward stop lugs 23 between which is interposed conventional draft gear 25 and its associated front follower 22. Draft gear 25 is shown only diagrammatically as its specifics have nothing to do with the present invention.

The draft gear 25 and its front follower 22 are embraced, as is conventional, by vertical yoke 24 which is connected to the shank 26 of the coupler 10 by connector pin 28 that is supported by support plate 30 that is secured across the center sill 12, at the level of its undersides 32 and 34, by suitable rivets 36. As usual, the spherically contoured inner end 35 of the coupler seats against the correspondingly contoured force transmitting recess 37 of the front follower 22.

Figure 2:
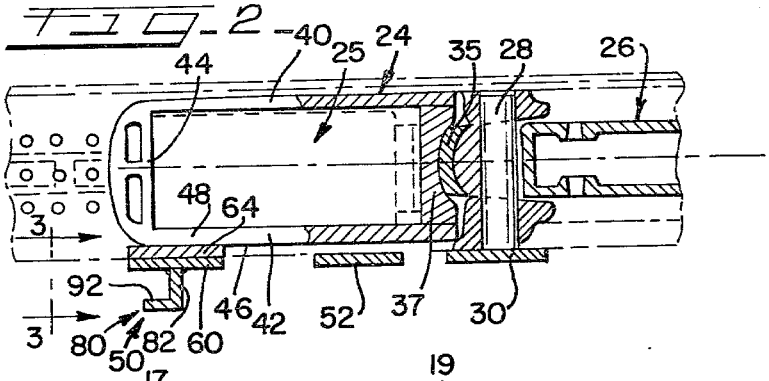
FIG. 2 is a vertical sectional view through the draft rigging and associated parts shown in FIG. 1, with parts being shown in phantom and the draft gear being shown in block diagram form, illustrating the application of the present invention thereto.

The yoke 24 comprises the usual upper and lower straps or arms 40 and 42 that are suitably apertured as indicated in FIG. 2 to receive the connector pin 28, and that are integrally connected together at the inner end 43 of the yoke by the yoke bight portion 44.

The underside 46 of the yoke lower strap 42 is generally flat or planar in configuration, and at its inner end 48, it is supported by and rides on the conventional yoke wear plate that is replaced, in accordance with the invention of said Chierici and Murphy patent, by the yoke wear plate assembly indicated at 50 in the showing of FIGS. 1–5. Conventionally the draft gear rigging involved also includes a flat safety plate 52 secured across the center sill 12 at the level of its undersides 32 and 34, by employing appropriate rivets 54. As indicated in FIG. 2, the safety plate 52 is disposed below the normal working level of the yoke lower strap 42 so as to be out of contact with same.

The conventional yoke wear plate that is not illustrated is customarily secured across the center plate in the same manner as plates 30 and 52, and is indented upwardly so as to dispose the yoke 24 in proper working level alignment with the coupler longitudinally of the center sill (see page 534 of the 1970 Edition of the Car and Locomotive Cyclopedia).

The wear plate assembly 50 in the specific form shown comprises planar, totally flat, plate 60 that is free of the aforementioned upward indentation, and that is fixed across the center sill at the level of the center sill undersides 30 and 34, as by employing suitable rivets 62 applied through align holes 63 and 65 formed in plate 60 and the center sill flanges 18 and 18A, respectively. Plate 60 has applied to same liner 64 which is of molded or extruded one piece construction and is formed from an ultra high molecular weight polymer of dry self lubricating characteristics. In the form illustrated, liner 64 is of plate configuration having the same width as plate 60 and is secured to plate 60 by employing suitable bolt and nut assemblies 67 applied to the aligned holes 69 and 71 of liner 64 and plate 60 for that purpose that are located to either side of midportion 73 of the liner on which yoke 40 is to ride.

In the preferred embodiment, the polymer is the polyethylene disclosed in said application, and for this application preferably has a molecular weight of at least about 3,500,000 and no greater than about 10,000,000.

Polyethylene having the ultra high molecular weight range indicated provides a liner having surfacing that is characterized by resistance to adherence thereto of foreign matter, while being self lubricating in nature and providing a coefficient of sliding or dynamic friction of the yoke surface 46 on the liner on the order of 0.20. The material in question, in addition to being a high strength wear resisting material also is characterized by effecting on the yoke surfacing riding on same a polishing or honing resurfacing action such that after a period of normal use, the yoke surfacing in question takes on a mirror-like finish whereby the wear surface of the yoke in question becomes effectively resistant against further wear. Metal worn off the yoke, during the polishing action in question, seems to embed itself in the liner wear surface, to the extent it remains in the locale of the parts involved. Any foreign matter that is caught between the two surfaces involved also seems to become embedded in the liner surfacing, and thus is positioned to avoid any wearing action on the yoke wear surface involved. As indicated, since the material from which the liner is made resists adherence thereto of foreign matter, such foreign matter does not accumulate on the liner and it is only grit and the like that becomes trapped between the two surfaces that is subject to the embedding action indicated.

The specific liner 64 shown in the drawing Figures comprises a plate member 70 formed to define upwardly facing load support surface 72 on which yoke strap 42 rides. Plate member 70 is proportioned and located on plate 60 so that its ends 74 and 76 will be closely adjacent the inner surfaces 17 and 19 of the respective center sill sides 16 and 16A, to center the liner 64 with respect to the yoke it is to support and within the confines of centersill 12.

The plate member 70 has a thickness equivalent to that which will support the yoke inner end 43 for proper working alignment with the coupler 10 longitudinally of the center sill, which dimension is approximately ⅜ths of an inch in practicing the invention of said patent. This disposes the yoke and the draft gear it embraces in horizontal level alignment with the center line of draft (indicated at 75), in the installed relation of assembly.

In use, and as disclosed in said patent, as the coupler 10 is acted on by the usual buff and draft impacts, the draft gear 20 functions in the normal manner to absorb the impacts, which will involve the yoke 24 moving longitudinally of the center sill inwardly and outwardly of same, which involves a sliding of the yoke undersurface 48 on the upper surface 76 of the liner 64. The invention when having the installed relation shown in the drawings acts to substantially eliminate the usual mechanical wear experienced on conventional yoke and wear plate arrangements by the dry self lubricating characteristics of the material forming the liner 64, and by the gradual forming on the yoke undersurface 48 of the aforementioned mirror-like surfacing which tests have shown to have the effect of making the metal of the yoke resistant to further wear due to relative movement with respect to the liner 64 and its support plate 60.

The wear plate assembly also serves as a sound deadener and impact energy absorber, and thus is particularly useful in the case of caboose and other cars where noise is a problem. Liner 64 avoids the metal to metal contact of conventional arrangements that are a source of much noise pollution due to the banging together of the metal parts involved.

The plate member 70 is preferably formed from the molecularly oriented UHMW polyethylene marketed by Ketrol Enterprises of York, Pennsylvania under the trademark TUFLAR (Grade PL). This material is a high density polymer of dry self lubricating characteristics that is sufficiently compaction resistant to resist any substantial compaction under compressive forces up to its elastic limit, and has a high degree of elastic memory for full return to original free standing shape after being stressed, up to its elastic limit. This material also has a high degree of toughness and long wearing characteristics, and is also receptive to fillers in the form of glass, clay, sand, suitable fabrics, and alumina for modifying same to adapt the plate member 70 for special conditions.

As discussed hereinbefore, experience in service in practicing the invention of said Chierici and Murphy patent has revealed that the support plate 60 of which the special liner 64 is mounted tends to deflect out of its initial planar relation after a period of use, due to the static and dynamic loads that act on it through the liner plate 70, with the result that after a period of use the portion of the plate 60 between its connections to the center sill becomes somewhat arced downwardly. The liner 64 has sufficient flexture characteristics under the corresponding loads involved such that it conforms to the indicated arcing of the support plate 60, with the result that the undersurface 46 of the yoke lower strap 42 will not be in full flush engagement with the liner load support surface 76; the yoke lower strap 42 will thus tend to ride on the liner surface 76 along the side edges of the yoke lower strap, and be spaced from the liner load support surface 76 along the longitudinal center of the yoke lower strap 42. This reduces the effectiveness of the liner 64 both from the standpoint of the resurfacing of the lower yoke strap undersurfacing and the support of the draft gear 25 at the desired working level alignment with the coupler 10.

Figure 3:
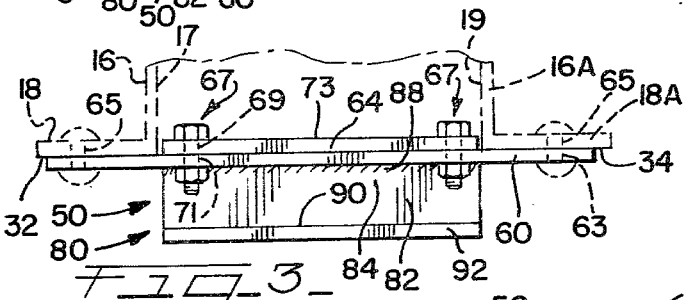
FIG. 3 is a fragmental view taken substantially along line 3—3 of FIG. 2, showing the wear plate assembly of the present invention, with the wear plate liner partially broken away, and the center sill shown in phantom.
Figure 4:
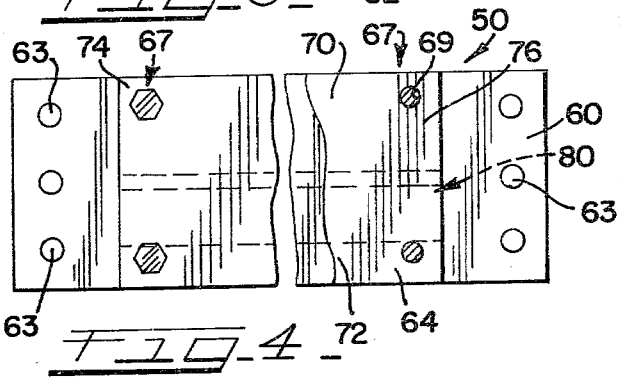
FIG. 4 is an enlarged top plan view of the wear plate assembly shown in FIG. 3, with parts broken away.
Figure 5:
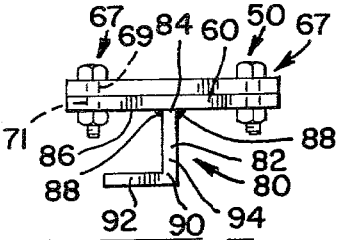
FIG. 5 is an end view of the wear plate assembly that is shown in FIG. 2, but on an enlarged scale.

In accordance with the present invention, the support plate 60 is equipped with a rigidifying flange structure 80 that extends longitudinally of the support plate 60, and along its longitudinal center line, in coextensive relation with the liner 64 (see FIG. 3–5).

The rigidifying flange structure 80 comprises vertical flange 82 suitably affixed along its upper edge 84 to the undersurface 86 of support plate 60, as by employing welding at 88. Vertical flange 82 is thus disposed in depending relation with respect to the support plate 60, and along its lower edge 90 the flange structure 80 includes a laterally extending horizontally disposed flange 92 that thus parallels the support plate 60.

While the flanges 82 and 92 may be in the form of separate rectilinear plates of the illustrated quadrilateral configuration suitably affixed together by welding or the like, the flange structure 80 may be conveniently formed by employing angle member 94 that is of one piece construction, and may be formed from angle bar stock made from a suitable steel.

In practice, it does not matter whether the horizontal flange 92 extends in the direction shown in FIGS. 2–5, or in the opposite direction. However, it is preferred that the flange 92 extend laterally of the support plate 60 at least one-quarter of the width of the plate 60. It is also preferred that the horizontal flange 92 be disposed below the undersurface 86 of the support plate 60 a distance that approximates or is on the order of at least four times the thickness or gauge of the plate 60 for best results. Disposing of the flange 92 at a level below the plate 60 that is significantly in excess of the indicated level reaches a point of diminishing returns while at the same time disposing the flange 92 at excessively low levels relative to the flanges 18 and 18A of the center sill.

As indicated, flange structure 80 is to have approximately the same length as the length of liner 64 and is in coextensive relation therewith. The flange 82 should be affixed to the undersurface 86 entirely along the length of the flange 82 for best results.

The resulting wear plate assembly 50 provides an arrangement in which the intended and initial planar shape of support plate 60 is maintained against the static and dynamic loads imposed on the wear plate 60 when the car equipped with the assembly 50 is in service. The liner 64, and thus its load support surface 76, are thus maintained in proper horizontal planar relation for full flush engagement with the undersurface 46 of the lower strap 42 for insuring that the full benefits of the invention disclosed in said Chierici and Murphy patent are obtained during the useful life of assembly 50.

Another benefit provided by the assembly 50 is that support plate 60 may be of significantly reduced gauge for performing its load support functions in conjunction with the flange structure 80. Heretofore, conventional wear plates have been formed from plate stock having a gauge or thickness of $\frac{5}{8}$ths of an inch. Plate 60 may be formed from plate stock having a gauge or thickness of $\frac{1}{4}$ inch with good results.

The gauge of the flanges 82 and 92 may be the same, and preferably approximates the gauge of support plate 60.

While the wear plate assembly illustrated is shown applied to a type F coupler application, it is equally applicable to type E coupler applications as replacements for the conventional wear plates therein employed, with like benefits to the yokes involved. The upward indenting or building up of the conventional yoke wear plates for type E coupler equipment, which is similar in amount to that required for type F equipment is thus avoided by doing the proper positioning of the yoke with the indicated thickness of the liner.

It will therefore be seen that the invention provides a wear plate assembly for draft gear rigging yokes which is of simplified nature and yet has the capability of eliminating the hereinbefore mentioned wear problem on the yoke and its wear plate.

The invention is equally applicable to new and old equipment, and when applied, not only provides for a dry self lubricating type action, but also a resurfacing of the yoke undersurface which results in both the yoke and its wear plate assembly being protected against undue wear following the disclosure of said patent. As the material from which the liner of the invention is made resists adherence thereto of foreign material, the abrasive effect of foreign matter that is usually found in equipment of this type, especially where wet type lubricants are employed, will be largely avoided, with any trapped foreign matter becoming embedded in the liner. The term "foreign matter" in this regard means the dirt, grit, dust, road bed particles and the like that under the car equipment is exposed to in service, as is well known in the art.

The invention in permitting plate stock of reduced gauge to form the support plate 60 also permits as much as two pounds in weight to be eliminated from each end of the car in the area of the draft gear pocket. This contributes to savings of locomotive fuel where the train is made up of a number of freight cars equipped in accordance with this invention.

Furthermore, the liner, when the car is operating, absorbs the energy of impacts against it due to yoke movements relative to it, and in avoiding metal to metal contact between the yoke and its wear plate, also acts as a sound deadener.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a draft gear rigging for railroad cars having a channel shaped center sill opening downwardly and extending longitudinally of the car, with the rigging mounted at the end of the car and comprising a draft gear applied within the draft gear pocket between stops spaced longitudinally of the car and within the center sill, which draft gear is embraced by a yoke extending longitudinally of the car and operably connected to the car coupler, with the yoke being supported by a support plate secured at its ends at the underside of the center sill, said support plate being planar in configuration and paralleling and being coplanar with the underside of the center sill, and including a liner formed from a polymer of dry self lubricating characteristics and interposed between the support plate upper side and the yoke underside on which the yoke inner end rides to dispose the yoke underside at its operative level within the center sill, the improvement wherein:

the support plate has fixed to its underside along the longitudinal midportion of same a depending flange structure including a vertically disposed flange of rectilinear configuration defining an upper side portion made fast to the support plate and a lower side portion spaced vertically below the support plate and defining a horizontal flange projecting normally of said vertical flange for rigifying the support plate in its planar configuration against the weight of the draft and yoke riding on the liner.

2. The improvement set forth in claim 1 wherein:

said horizontal flange projects sideways of said vertical flange at least to the extent of underlying one quarter of the width dimension of the support plate.

3. The improvement set forth in claim 2 wherein:

said upper side portion of said vertical flange is welded to the support plate underside along the length of said vertical flange, said flange structure being centered on and having a length substantially equaling that of the liner.

4. The improvement set forth in claim 2 wherein:

said flange structure is a one piece component formed from steel.

5. The improvement set forth in claim 2 wherein:

said support plate has a gauge approximating one quarter inch.

6. The improvement set forth in claim 2 wherein:

said horizontal flange is disposed below the support plate a distance on the order of four times the gauge of the support plate.

* * * * *